US006083432A

United States Patent [19]

Schafer

[11] Patent Number: 6,083,432

[45] Date of Patent: Jul. 4, 2000

[54] MELT SPINNING APPARATUS

[75] Inventor: Klaus Schafer, Remscheid, Germany

[73] Assignee: Barmag AG, Remscheid, Germany

[21] Appl. No.: 08/923,205

[22] Filed: Sep. 4, 1997

[30] Foreign Application Priority Data

Sep. 4, 1996 [DE] Germany ..... 196 35 846

[51] Int. Cl.[7] ..... D01D 4/08

[52] U.S. Cl. ..... 264/39; 425/72.2; 425/190; 425/192 S; 425/378.2; 425/382.2; 425/464

[58] Field of Search ..... 425/72.2, 190, 425/192 S, 191, 378.2, 382.2, 464; 29/428, 525.02; 264/39

[56] References Cited

U.S. PATENT DOCUMENTS

| | | | |
|---|---|---|---|
| 2,841,821 | 7/1958 | Phipps | 425/192 S |
| 3,458,900 | 8/1969 | Shinkai et al. | 425/191 |
| 3,509,244 | 4/1970 | Cochrane, Jr. | 425/382.2 |
| 3,562,858 | 2/1971 | Lehner | 425/382.2 |
| 3,655,314 | 4/1972 | Lenk et al. | 425/192 S |
| 3,767,347 | 10/1973 | Landoni | 425/382.2 |
| 3,891,379 | 6/1975 | Lenk | 425/382.2 |
| 4,035,127 | 7/1977 | Ogasawara et al. | 425/192 S |
| 4,645,444 | 2/1987 | Lenk et al. | 425/192 S |
| 4,648,826 | 3/1987 | Ogasawara et al. | 425/192 S |
| 4,696,633 | 9/1987 | Lenk et al. | 425/192 S |
| 5,352,106 | 10/1994 | Lenk et al. | 425/192 S |
| 5,354,529 | 10/1994 | Berger et al. | 425/192 S |
| 5,733,586 | 3/1998 | Herwegh et al. | 425/192 S |

FOREIGN PATENT DOCUMENTS

| | | |
|---|---|---|
| 0 163 248 | 1/1990 | European Pat. Off. . |
| 22 18 239 | 1/1984 | Germany . |
| 33 43 714 | 6/1984 | Germany . |
| GM 84 07 945 | 7/1984 | Germany . |
| 760329 | 10/1956 | United Kingdom . |
| 1 391 844 | 4/1975 | United Kingdom . |

*Primary Examiner*—Patrick Ryan
*Assistant Examiner*—Joseph Leyson
*Attorney, Agent, or Firm*—Alston & Bird LLP

[57] ABSTRACT

A melt spinning apparatus for extruding and spinning thermoplastic filaments as part of the fabrication of a multifilament yarn. The apparatus includes a plurality of spinning units arranged in a row in a gas tight heated container, and each spinning unit comprises upper and lower coaxial pipes which are interconnected by means of a common supporting plate. The melt metering pump and the spinneret assembly are mounted within the pipes. A method of fabricating the apparatus is also disclosed.

24 Claims, 8 Drawing Sheets

MELT SPINNING APPARATUS

BACKGROUND OF THE INVENTION

The present invention relates to a melt spinning apparatus for extruding and spinning thermoplastic filaments, and of the type generally disclosed in DE 33 43 714 A1.

Extrusion spinning devices for spinning manmade fibers which have the spinning heads arranged in spinning beams are known in various designs from prior art—see, for example, U.S. Pat. No. 3,891,379, DE 33 43 714 A1, DE-GM 84 07 945 or EP-B 0 163 248. All, or at least most of the known spinning devices are of a technically elaborate design so as to achieve at least approximately identical operating conditions at the spinning units operated, in each case, by the same program. Such efforts are necessary and also customary for manufacturing high-quality multifilament yarns. As a result, the necessary outlay for maintenance is also high.

From the initially cited DE 33 43 714 A1, an installation for double-sided, continuous spinning of manmade fibers is known, which has a double-sided spinning block. The spinning block comprises a closed, heated structural part, inserted in a penetrating manner into which are pipes, which are aligned vertically and in a row and accommodate spinning units each comprising a filter and a spinneret body. Housed in the spinning block are melt metering pumps (metering gear pumps), to which spinning melt is supplied through distribution lines from a melting extruder and which in turn feed the spinning melt to the spinning units. Of the melt metering pumps, however, it is, in each case, only the part containing the connections for the spinning melt which projects into the heated structural part or container.

Heating of the closed container is effected by an oil, described as diathermic in DE 33 43 714 A1, which is heated by electrical resistance heating elements and contained in a sump provided under the spinneret units. It is, however, only the parts situated in the closed interior of the spinning block which are heated.

The construction known from DE 33 43 714 A1 also has considerable drawbacks. The structural part comparable to a spinning beam is of a very fissured design which is very costly to manufacture. Also, as already mentioned, the melt metering pumps lie in the heat insulation and only partially inside the closed container. They are therefore only partially heated.

It is accordingly an object of the present invention to reduce the outlay required to manufacture as well as to operate and maintain the spinning units and achieve identical production conditions for all spinning units of the spinning apparatus.

SUMMARY OF THE INVENTION

The above and other objects and advantages of the invention are achieved by the provision of a melt spinning apparatus which comprises a gas tight container defining a top wall and a bottom wall, with the top and bottom walls having vertically aligned top and bottom openings therein respectively. A melt spinning unit is disposed in the container and extends between the top and bottom openings, and the melt spinning unit comprises a first pipe secured in said top opening and extending downwardly therefrom, and a second pipe secured in said bottom opening and extending upwardly therefrom. The melt spinning unit also includes a supporting plate secured to each of the first and second pipes so as to interconnect the same, with the supporting plate filling the internal cross section of each of said first and second pipes. A melt metering pump is secured to said supporting plate, and a spinneret assembly is secured below said supporting plate. Also, a melt distribution line extends into the supporting plate and leads to the melt metering pump and from the melt metering pump to the spinneret assembly.

The advantages of the spinning apparatus according to the present invention are uniform heating of all melt-carrying structural parts for all spinning units and good accessibility of the subassemblies comprising the melt metering pump, pump drive and spinneret assembly which are to be maintained. Advantageous solutions also arise for the assembly and installation of prefabricated subassemblies into the container enclosing the spinning units.

The central structural part of the spinning unit is, in each case, the supporting plate fitted in a fixed manner into each pipe, with its melt channel and connection to the melt distribution line. The supporting plate completely fills the cross section of each pipe and prevents heat losses caused by a stack effect in the vertical pipes. The melt metering pump is, in each case, a small individual pump having an external contour adapted to the internal cross section of the pipe. It may be fastened—viewed in spinning direction—below the supporting plate or alternatively, on the supporting plate. In the first case, the spinneret assembly may be connected by a screw connection to a circular-cylindrical projection on the bottom pump plate; in the second case, the projection for fastening the spinneret assembly is on the underside of the supporting plate. Alternatively, it is provided that the spinneret assembly, which then carries the fastening means on its outer periphery, is fastened to the inner periphery of the vertical pipe which accommodates the melt-carrying structural parts.

The pump drive shaft is, in each case, mounted from above. In the first case, it is passed axially through the supporting plate, in the second case it is shorter and extends only as far as the pump gear wheels.

The melt supply is a tubular supply line which is sealingly connected, in particular by welding, to the base of the heating kettle or container which it penetrates. Inside the container, the supply line extends without a gradient and runs equidistantly alongside the row of spinning units. In a preferred construction, the connection between the supply line and the melt distribution line which is provided in the supporting plate and leads to the spinning pump, is established by a branch line which runs, in each case, from the supply line to the melt distribution line in the supporting plate and which in particular emanates from the underside of the melt supply line. The latter is preferably positioned higher than the inlets of the melt distribution lines in the supporting plates.

The melt supply may, however, alternatively be so designed that the supply line in the spinning beam divides into a plurality of branch lines of equal length and preferably identical pressure difference, which are each connected to the melt distribution line in the supporting plate of a spinning unit.

The individual spinning pump comprises three plates with two side walls and the collar plate which receives the gear wheels. The spinning pump may, by being lifted out in an upward direction or alternatively after unscrewing of the spinneret assembly, be removed, e.g., for cleaning or parts exchange and then reinserted.

According to the invention the spinneret assembly, which includes a tubular casing, an apertured spin plate, a filter insert, a distribution plate and a pressure piston loading the sealing diaphragm, is suspended from the spinning pump fastened to the supporting plate or from the supporting plate itself. To said end, the downward pointing wall of the bottom spinning pump plate may have on its underside a projection provided with a thread. The top edge of the spinneret casing is provided with an opposing thread so that the spinneret assembly may be screw connected to the spinning pump. The projection may be annular and have an internal thread or it may have a circular-cylindrical enveloping surface with an external thread. For mixing once more the melt exiting from the spinning pump, a statically acting mixing insert may preferably be inserted into a central bore of the pressure piston. Further preferred forms of fastening are a bayonet catch or a threaded connection to the lower pipe which accommodates the spinneret assembly.

The ideal shape for the container according to the invention for receiving the heating medium is one which is smooth and has as few fissures as possible. In such case, the basic shape of the cross section may be substantially rectangular or circular, a deciding factor possibly being that a large selection of pipes of various diameters, wall thicknesses etc. are available as a starting material for a circular-cylindrical housing, while a rectangular cross section may offer advantages in terms of design. In any case, the necessary gas and pressure tight connection between the container wall and the spinning units or the pipe portions forming the ends of the spinning units may be established directly or indirectly by welding.

The procedure for manufacturing the spinning apparatus according to the invention may be such that—optionally using a suitable assembly device which guarantees the precise position and dimensional accuracy during arrangement of the individual parts of the spinning units and the melt supply system—first the spinning units are assembled and spatially connected to the melt supply line in such a way that they may be inserted as a structural unit into the open-ended container previously provided with the penetration holes, which receive the vertical pipes or mark their location.

Here, care has to be taken that, for such purpose, the length of the assembled spinning units has to be smaller than the height of the rectangular container or the chords of the container with a circular pipe cross section which lie in the planes touching the spinning units.

In either case, after reaching the mounting position, the entire built-in part with the bottom ends of the lower pipes (also referred to herein as the assembly pipes) may be lowered in such a way that the ends may be introduced into the provided openings of the container and connected to the housing. Then, using suitable means, the top ends of the upper pipes (connecting pipes) may be connected in a gas and pressure tight manner to the openings in the top container wall.

Thus, in a preferred embodiment of the invention, the connection may be established by first welding the bottom edge of the assembly pipe, after insertion, directly to the container wall. Then the connecting pipe is connected to the spinning beam housing, e.g. a mounting ring may be provided which has a pipe socket and an inside diameter corresponding to the outside diameter of the connecting pipe with a slight assembly clearance. The mounting ring is first loosely inserted into the top housing opening and slipped over the connecting pipe. Then, for example, to fix the pipe socket of the mounting ring in position, it may be welded first to the housing and then to the top edge of the connecting pipe.

To maintain as uniform a temperature as possible in the entire spinneret assembly, the necessary gap between assembly pipe and spinneret assembly should be as narrow as possible. Thus, so that a narrow and uniform gap is not jeopardized by welding the assembly pipe to the wall of the container, a further possibility of establishing a gas and pressure tight connection between the assembly pipe and the container wall is provided for example, optionally prior to insertion of the mounting part, by welding a mounting ring into each bottom opening. Each mounting ring is sized for receiving the assembly pipe, and at their ends extending into the housing, the rings have sealing collars directed radially inwards. On the free ends of the assembly pipes, it is possible to provide externally threaded rings, which prior to assembly are slipped onto and connected in a gas-tight manner to the pipe and which likewise at their ends have a radial sealing collar, which cooperates with the sealing collar of the mounting ring. By means of threaded nuts, which are threadedly connected to the threaded rings, the radial collars of the mounting ring and threaded ring may be pressed together, and a sealing ring may be disposed between the collars.

Heating of the spinning beam may be effected in a known manner by a heating medium such as, for example, diphenyl which at spinning temperature is present in the form of saturated steam. For such purpose it is equally possible to use known heating devices situated outside of the spinning beam, such as independent individual heating systems integrated into the spinning beams, e.g., immersion heaters situated in the condensate sump.

BRIEF DESCRIPTION OF THE DRAWINGS

Some of the objects and advantages of the present invention having been stated, others will appear as the description proceeds, and when considered in conjunction with the accompanying drawings, in which.

DETAILED DESCRIPTION OF THE PREFERRED EMBODIMENTS

Figure 1:
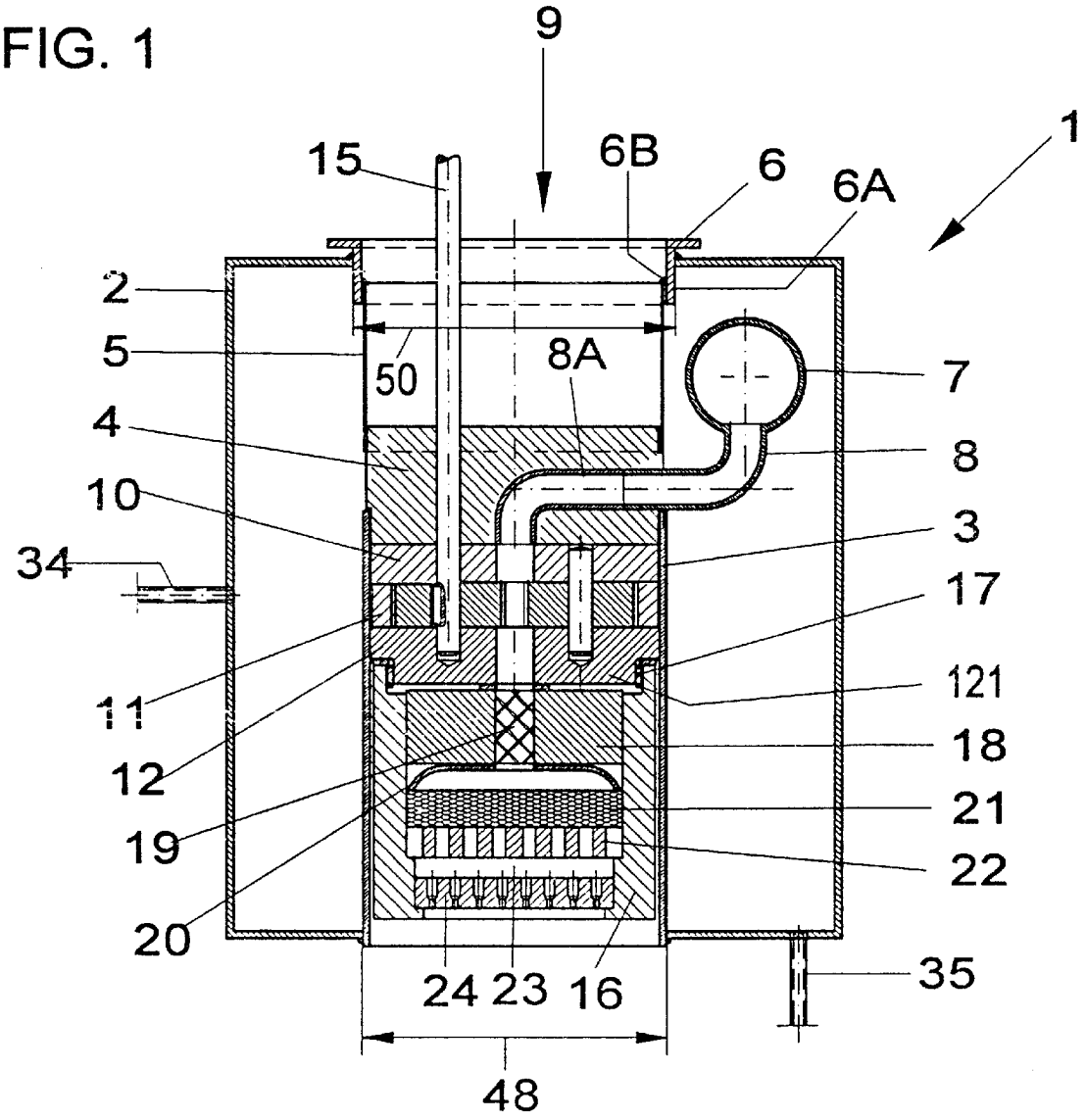
FIG. 1 is a cross sectional view of a melt spinning apparatus which embodies the present invention.

FIG. 1 shows, as a first embodiment, the cross section of a melt spinning apparatus 1 having a rectangular cross section with the melt supply line 7, spinning unit 9 and heating system.

The central part of the spinning unit 9 is a circular-cylindrical supporting plate 4, from the bottom edge of which a pipe portion 3 (assembly pipe) is slipped on and fastened in a gas and pressure tight manner, e.g., by welding. Inside the assembly pipe 3, a melt metering pump (spinning pump), which comprises a top lateral plate 10, a housing plate 11 (collar plate) receiving the gear wheels 13, 14, a bottom lateral plate 12 and the drive shaft 15 extending from above through a hole in the supporting plate 4 to the gear wheel 13, is fastened (not shown) preferably detachably to the underside of the supporting plate 4. For supplying melt to the spinning pump 10–15, a melt distribution line 8A is provided in the supporting plate 4, which leads from the periphery of the supporting plate to the spinning pump inlet. The line 8A also is connected by a branch line 8 to the melt supply line 7.

Here, it should be pointed out that, in the case of the selected design of the spinning pump, its inlet lies outside of the supporting plate axis and the selected representation reveals the path of the melt and not the actual associations. The representation therefore differs from the real situation.

The bottom lateral plate 12 of the spinning pump 10–15 has a central projection 121 provided with an external thread 17, to which a spinneret assembly 16 is screw-connected. The assembly 16 includes a tubular casing, a bottom spin plate 24 having a plurality of apertures therethrough, a melt chamber 23 above the plate 24, a distribution plate 22 above the chamber 23, and a filter insert 21 above the distribution plate 22. A sealing diaphragm 20 and a pressure piston 18 which loads said sealing diaphragm, are located above the filter insert, and a mixer, e.g., a static mixing element 19, is located in a central bore of the pressure piston 18.

From the top edge of the supporting plate 4 a pipe portion 5 (connecting pipe) likewise connected in a gas and pressure tight manner to the supporting plate extends upwards and substantially as far as an opening 50 in the top of the container wall 2, which opening is coaxial with the bottom opening 48 and has a slightly larger diameter than the bottom opening 48.

Figure 9:
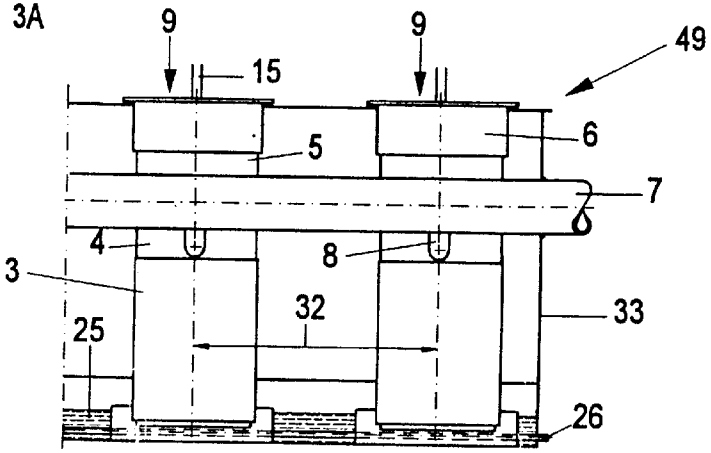
FIG. 9 is a side elevation view, partly broken away, of one embodiment of the melt spinning apparatus of the invention.

When designing and assembling the structural unit 49 according to FIG. 9, which comprises a plurality of spinning units 9 and their connection to the melt supply line 7, it should be ensured that there is room for the cross section of an envelope of the structural unit 49 in the free cross section of the container 2 (boiler, kettle). The required length of the assembly pipe 3 arises from the spatial requirement of spinning pump 10–15 and spinneret assembly 16, for which reason the length of the connecting pipe 5 is restricted to enable insertion of the structural unit 49 into the container 2. After insertion and alignment of the structural unit 49, the unit as a whole may be lowered far enough for a sufficient length of the assembly pipes 3 to project out from the edges of the bottom openings 48 to produce a weld joint, with the result that the welds may be produced at the periphery of the pipes 3. For this reason, however, the connecting pipes 5 terminate some distance below the top housing openings 50 which are coaxial with the bottom openings, so that a simple welding process is not possible.

FIG. 1 illustrates one possibility of establishing a connection between the individual connecting pipe 5 and the edge of the top housing opening 50. For such purpose, a mounting ring 6 which includes a radial flange, fits into the top opening 50 and is provided with a pipe socket 6A and has an inside diameter corresponding to the outside diameter of the connecting pipe 5 with a slight assembly clearance. The ring 6 is first inserted into the opening 50 and slipped over the connecting pipe 5 in such a way that the top edge of the latter projects into the pipe socket 6A. The pipe socket 6A is then welded at the periphery first to the container wall 2 and then to the top edge of the connecting pipe 5.

The spinning beam 1 according to FIG. 1 is heated indirectly, i.e. from a heat source (not shown) situated outside of the spinning beam 1, using diphenyl, for example, as a heating medium. For such purpose, supply lines 34 for the vaporous heating medium are provided in the container wall 2 and condensate outlets 35 are provided in the bottom of the spinning beam 1.

Figure 2:
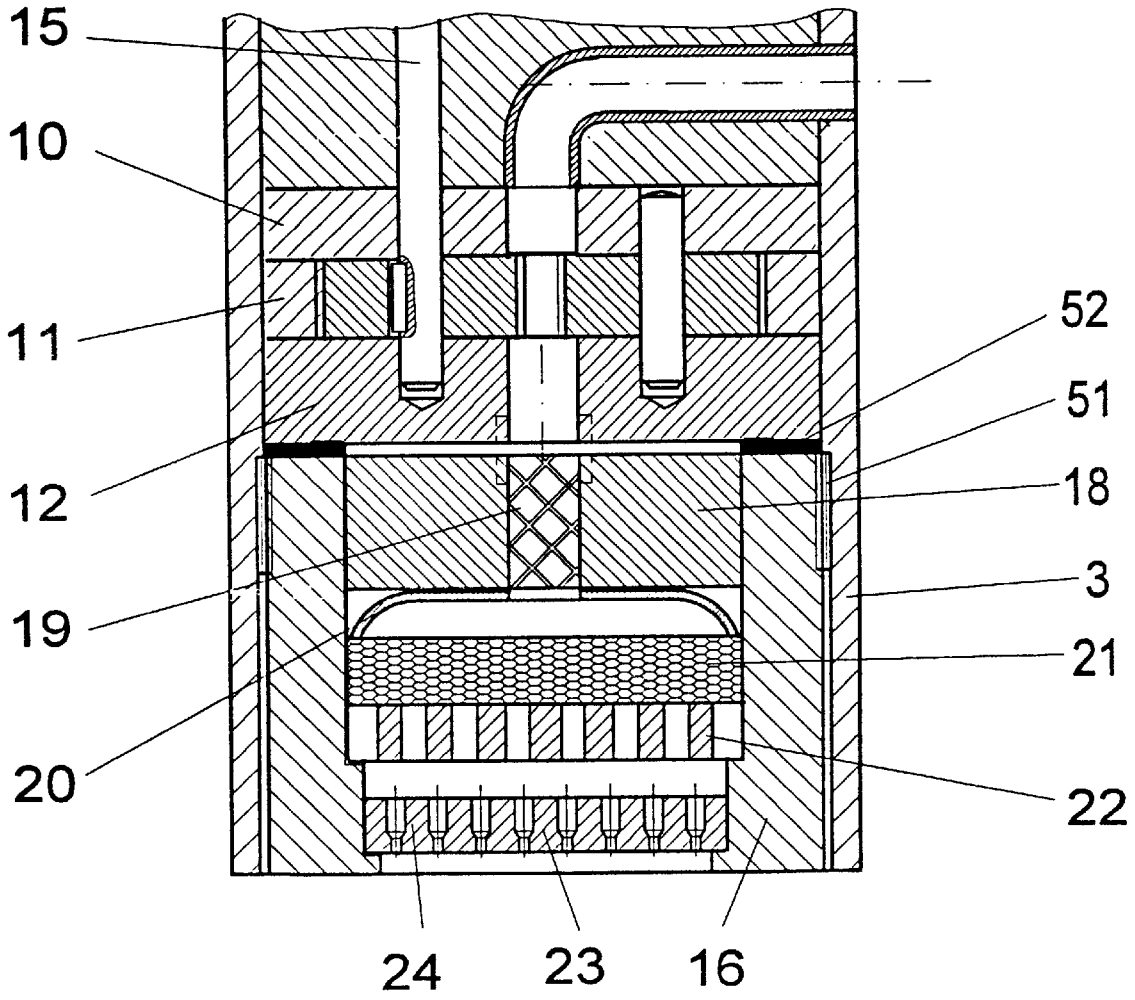
FIG. 2 is a fragmentary view similar to FIG. 1, but illustrating a modified structure for fastening the spinneret assembly to the spinning unit.

FIG. 2 illustrates a spinning beam 1 which is similar to that shown in FIG. 1, but which includes a modified fastening of the spinneret assembly 16. Here, the assembly pipe 3 is relieved in an axial direction to a slightly larger inside diameter and the top portion, which extends as far as the bottom lateral plate 12 of the spinning pump, is provided with an internal thread 51 or a bayonet joint. The spinneret assembly 16, which has an external thread or the counterpart of the bayonet joint, is screw-connected to the thread 51 or bayonet, and a sealing ring 52 being inserted between. The melt seal is guaranteed by the axial mobility of the pressure piston 18 which loads the sealing diaphragm 20.

Figure 3:
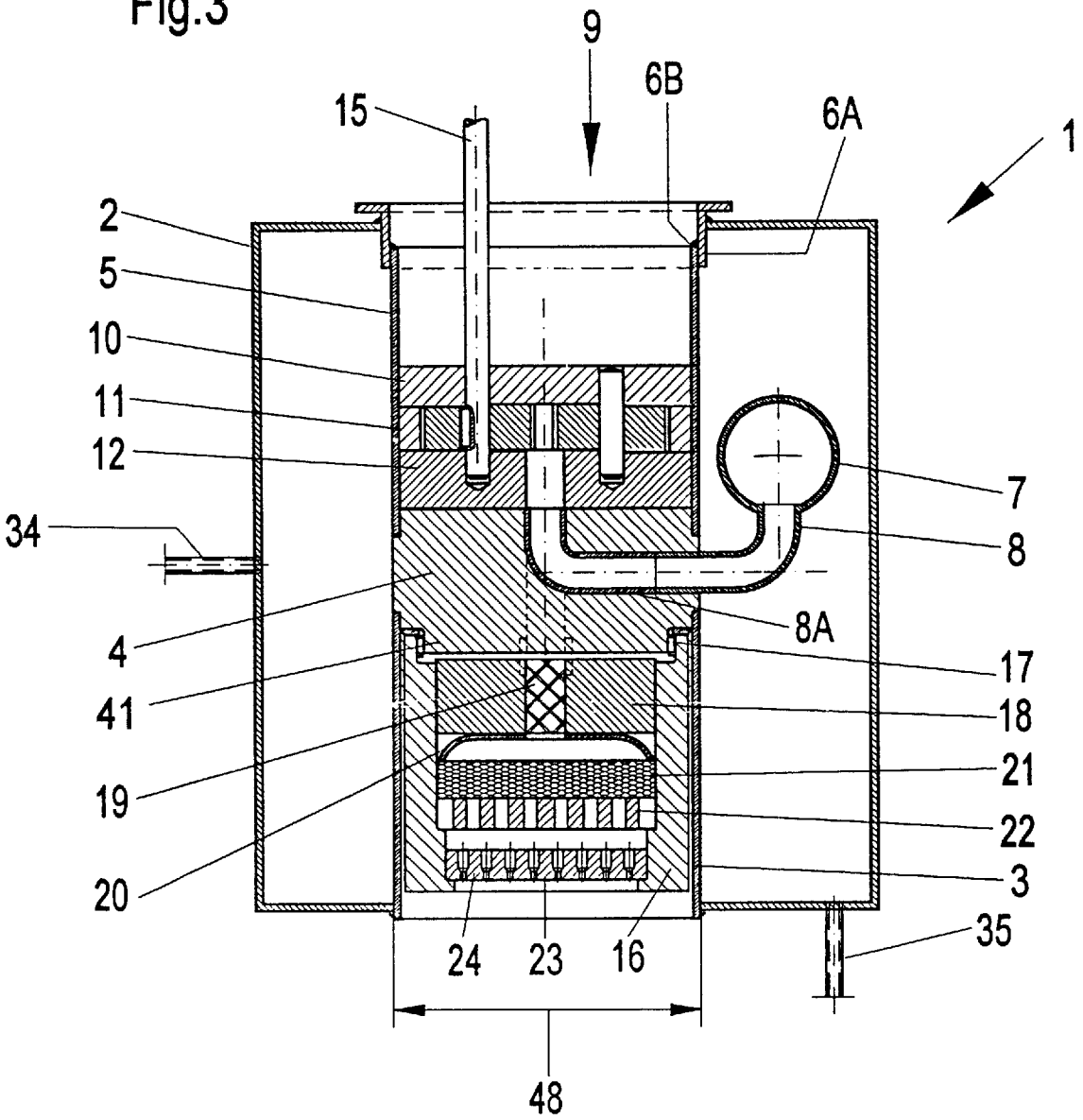
FIG. 3 is a view similar to FIG. 1 and illustrating a further embodiment of the invention.

FIG. 3 shows an alternative construction of the spinning unit 9. Here, the supporting plate 4 at its underside has a projection 41 with an external thread 17 for fastening the spinneret pot 16. The spinning pump is mounted on top of the supporting plate 4 and is removable in an upward direction through the connecting pipe 5. The melt distribution line 8A and the outlet channel are located in the supporting plate 4 in accordance with this construction. Otherwise the construction and assembly of the spinning beam 1 are as described above with reference to FIG. 1.

Figure 4:
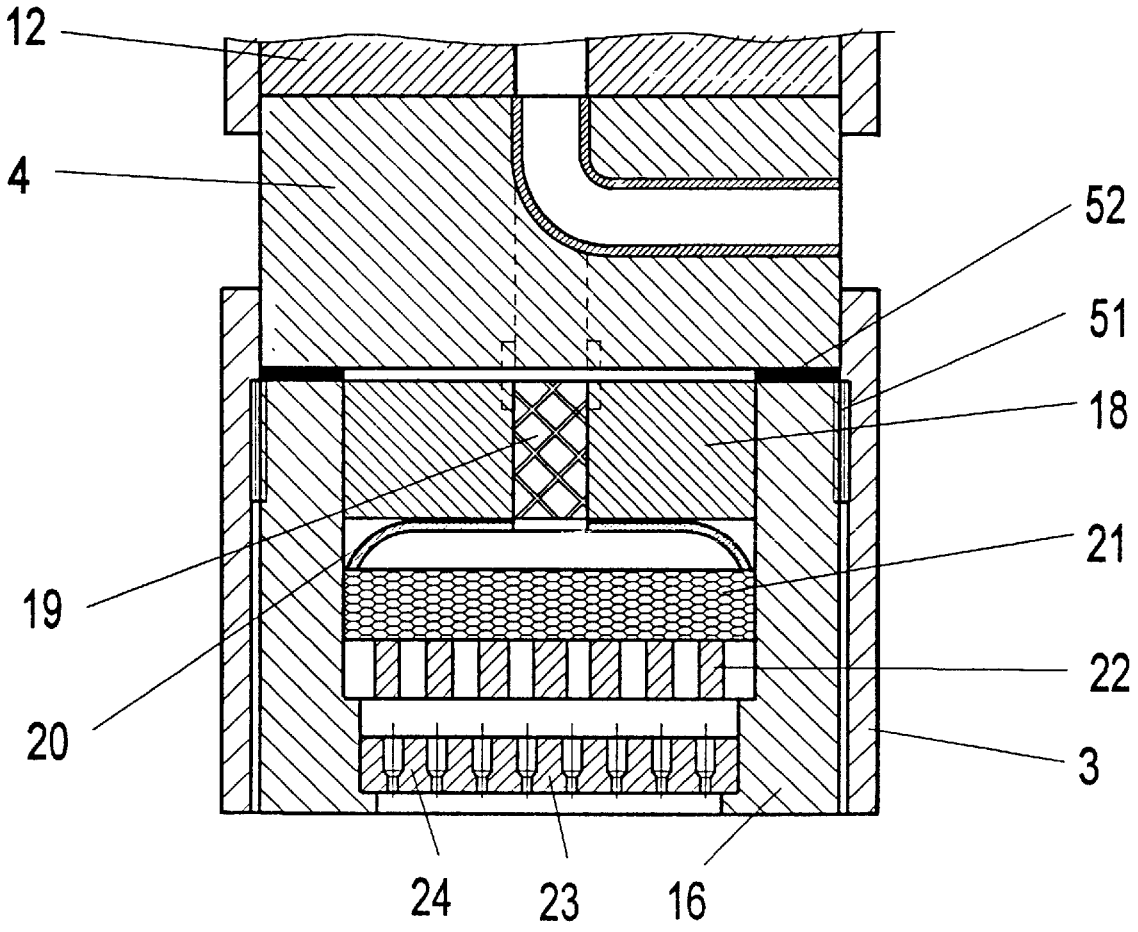
FIG. 4 is a view similar to FIG. 2 and illustrating a further embodiment of the invention.

FIG. 4 is a sectional view of the spinning apparatus according to FIG. 3 with a fastening of the spinneret assembly 16 according to FIG. 2 to the assembly pipe 3.

Figure 5:
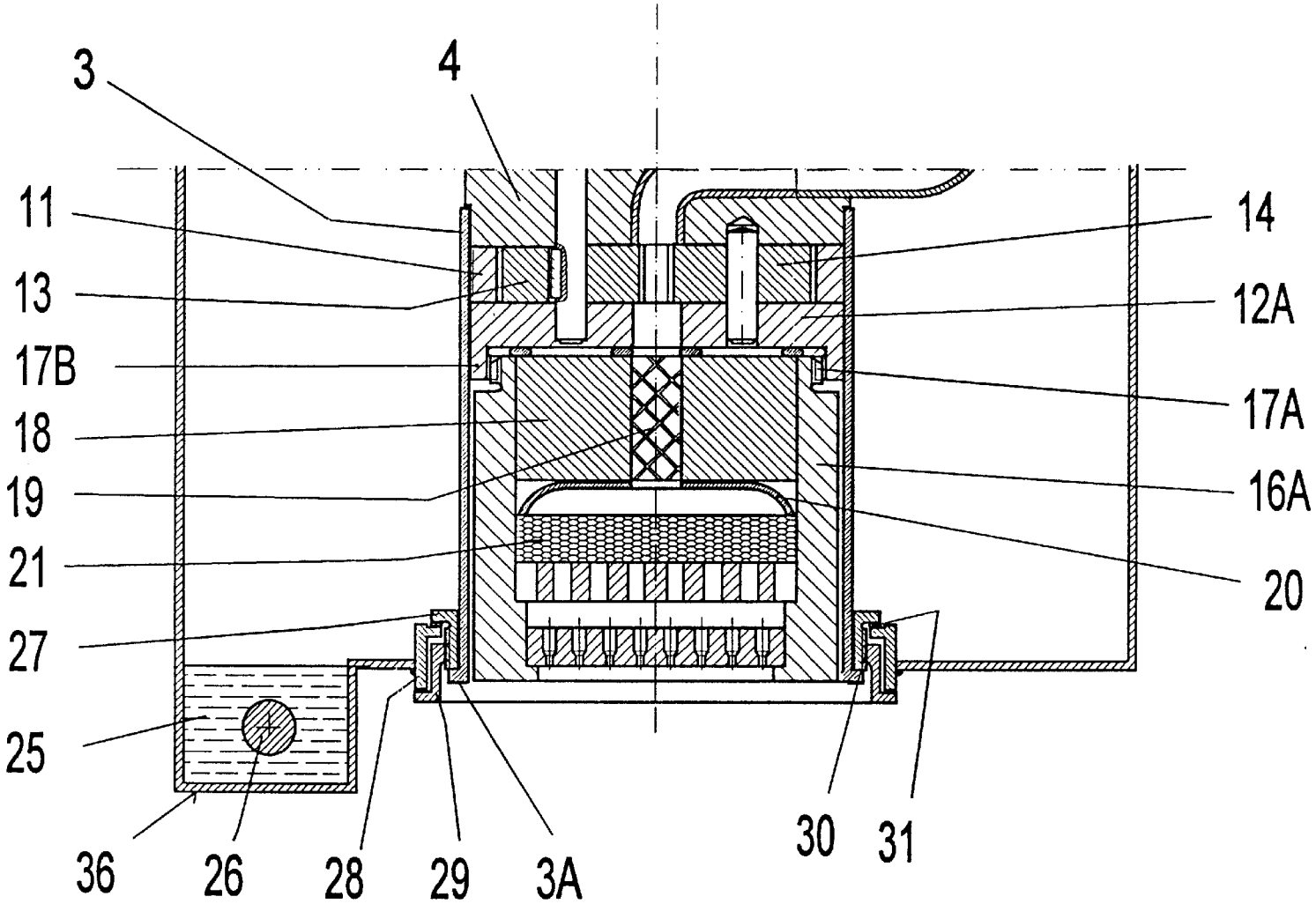
FIG. 5 is a view similar to FIG. 1 and which includes an internal heating system.

FIG. 5 shows the bottom part of the cross section of a construction of the spinning apparatus according to the invention which differs from that shown in FIG. 1. Here, a spinning pump 11, 12A, and 13–15 is installed, in which the top lateral plate 10 is replaced by the side of the supporting plate 4 which is directed towards the spinning pump. Also, the projection 17B on the bottom housing plate 12A is annular and provided with an internal thread 17A, while the spinneret assembly 16A has an external thread for its fastening to the projection 17B.

In order to prevent the assembly pipe 3 from becoming warped as a result of being welded to the container wall 2, the connection between the assembly pipe 3 and the bottom housing opening 48 shown in FIG. 5 is established by means of a screw-type connection 28–31 which is described in detail below with reference to FIG. 10.

In a further departure, the construction according to FIG. 5 has its own integrated heating system comprising a condensate collector 36 for the liquid heating medium 25 and an immersion heater 26, which is provided in the condensate collector and dips into the liquid heating medium. The condensate collector extends parallel to the row of spinning units 9.

Figure 6:
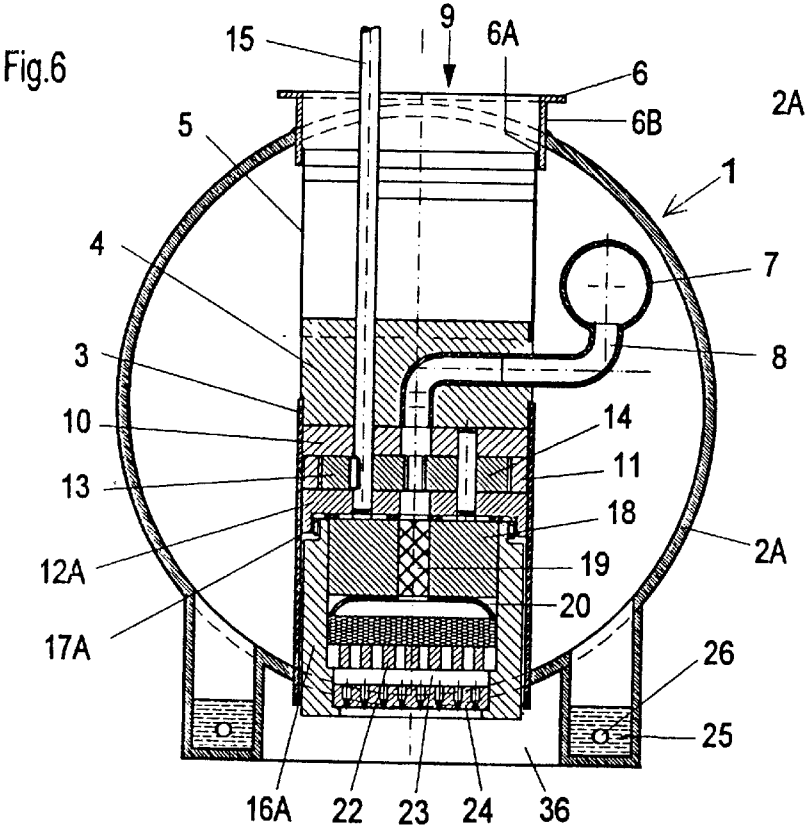
FIG. 6 is a view similar to FIG. 1 and illustrating still another embodiment of the invention.
Figure 7:
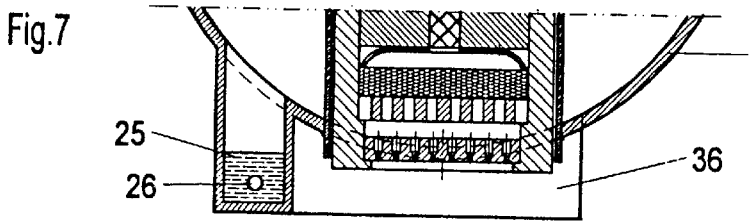
FIG. 7 is a fragmentary view similar to FIG. 6, and illustrating a unilateral heating arrangement.

The spinning unit 9 of the construction of the invention shown in FIGS. 6 and 7, including its connection to the wall of the container 2, is substantially identical to the construction described with reference to FIG. 1. It differs from the previously described embodiment mainly in that the container 2A has a substantially circular cross section. Heating is effected, in this case, by a condensate collector 36 integrated into the container 2A and having immersion heaters 26. In order to prevent condensate from accumulating between the spinning units 9, the condensate collectors, which are shown on both sides and connected to the container 2 substantially by individual openings for the saturated steam, are connected to one another and by smaller openings also to the interior of the container. The modification according to FIG. 7 dispenses with one of the lateral condensate collectors 36.

Figure 8:
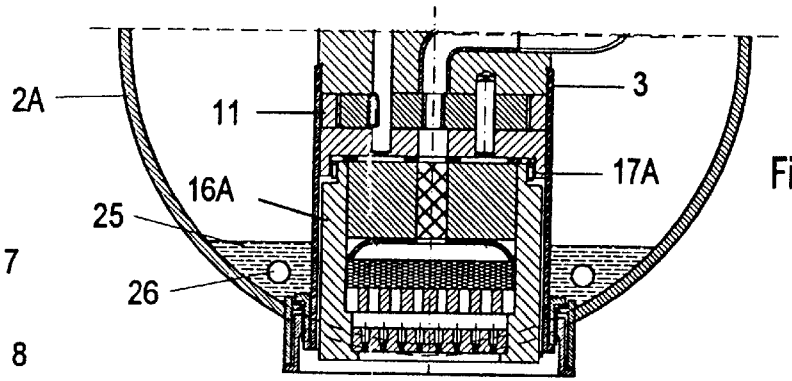
FIG. 8 is a fragmentary view similar to FIG. 6, and illustrating a heating system within the container.

In the construction of the invention according to FIG. 8, which likewise has a container wall 2A with a circular cross section, the construction of the spinning pump and the connection between the assembly pipe 3 and the container wall 2A are identical to those of FIG. 5. The heating with the heating medium 25 by means of immersion heaters 26 has, however, been shifted into the bottom part of the container.

FIG. 9 shows a side view of two spinning units 9 and a portion of the melt supply line 7 with the branch lines 8, the half of the container wall 2 closest to the viewer having been omitted. The view corresponds substantially to a construction according to FIG. 6 and shows in particular the connections of the condensate collector 36 provided between the spinning units 9. The spinning units 9 are preferably a fixed distance 32 apart. The base 33 of the container 2 may, however, in the case of higher heating steam pressure, preferably take the form of a commercially available dished boiler end.

Figure 10:
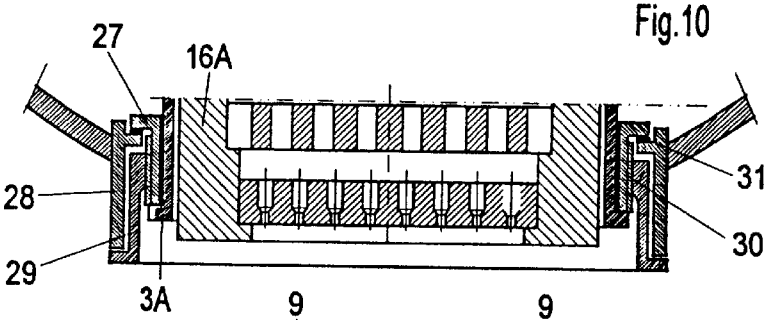
FIG. 10 is a fragmentary view illustrating a gas tight connection between the lower assembly pipe of a spinning unit and the container lower wall.

In FIG. 10 the screw connection between the assembly pipe 3 and the bottom housing opening 48, which is selected in the constructions according to FIGS. 5 and 8 so as to avoid troublesome distortions caused by welded joints, is shown to an enlarged scale while retaining the described connection between the connecting pipe 5 and the top housing opening 50 (not shown). Here, the bottom edge of the assembly pipe 3 has a collar 3A, and a threaded ring 27 with mounting thread 30 is connected in a gas and pressure tight manner to the assembly pipe 3. The threaded ring 27, at its upper end, has a projecting annular collar and has to be fitted prior to connection of the assembly pipe 3 to the supporting plate 4 or, in the absence of the collar 3A, prior to mounting of the structural unit 49. Welded into the housing opening 48 is a mounting ring 28 which, at its end directed into the container 2, has an internal collar. Both collars are dimensioned in such a way that they overlap one another.

For the sealing connection of the assembly pipe 3 to the container wall 2, a ring nut 29 is used which, when screwed in, is supported by a collar on the outer edge of the mounting ring 28 and presses the annular collar of the threaded ring 27, after insertion of a sealing ring 31 between, against the internal collar of the mounting ring 28. Such a solution is particularly suitable for lower heating steam pressures.

Figure 11:
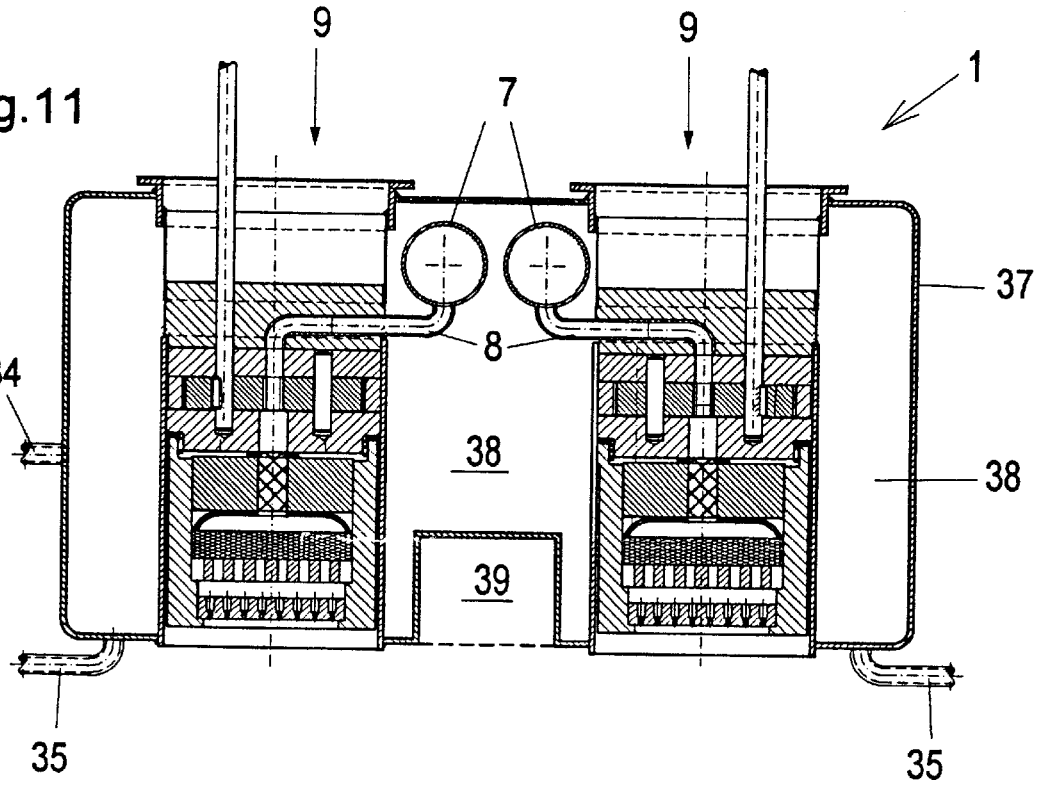
FIG. 11 illustrates a melt spinning apparatus composed of two rectangular containers which house two parallel rows of spinning units.
Figure 12:
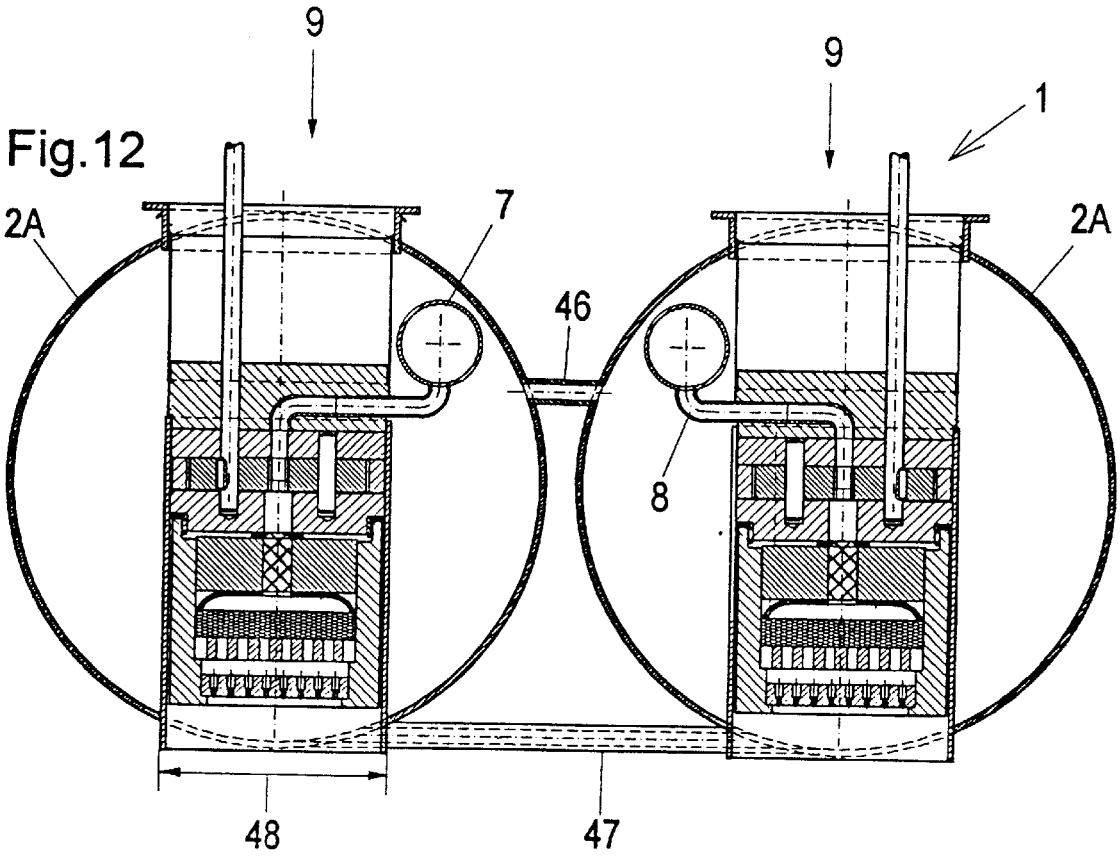
FIG. 12 illustrates an embodiment composed of two circular containers, each housing a row of spinning units.
Figure 13:
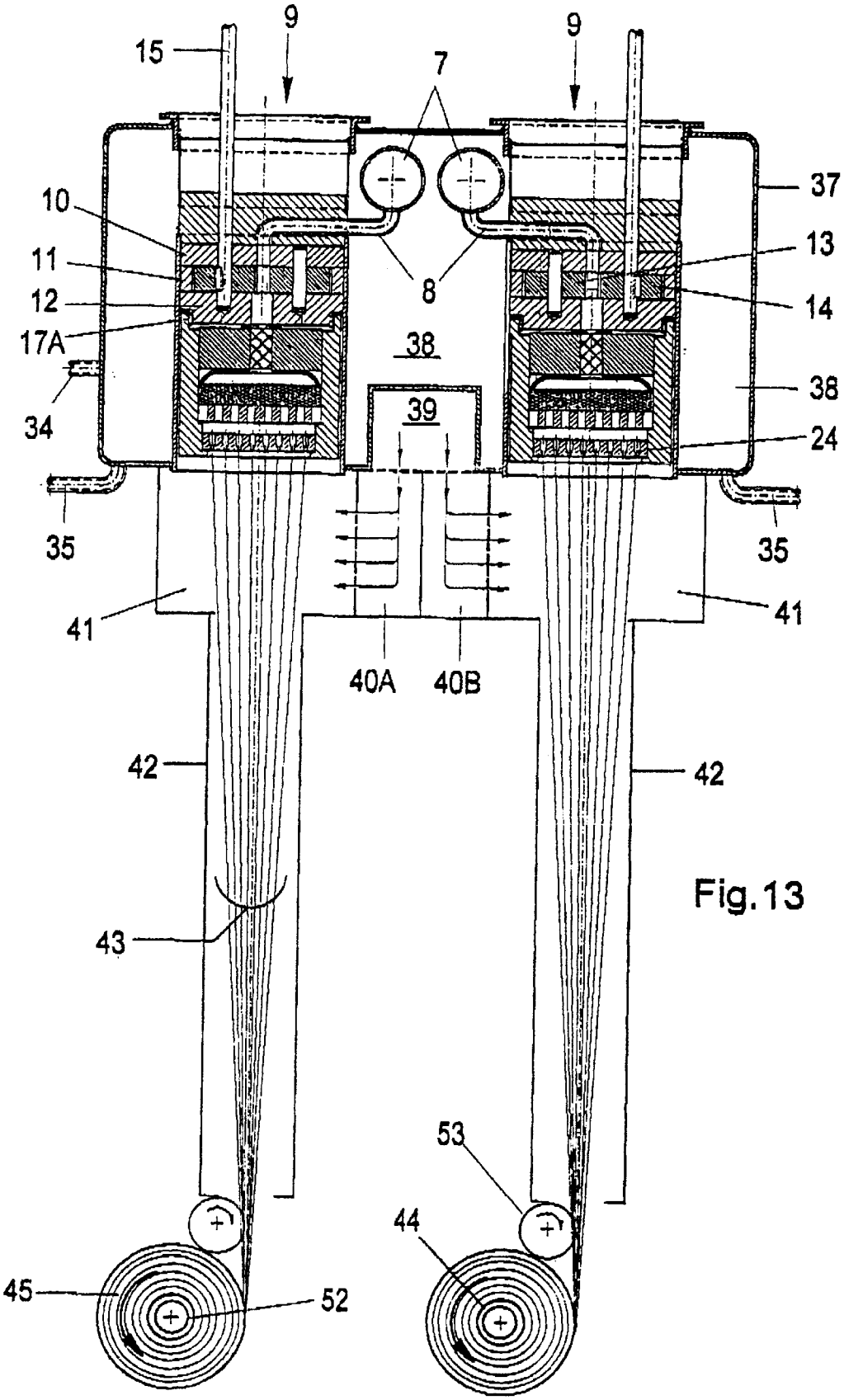
FIG. 13 illustrates an embodiment similar to that shown in FIG. 11, and further illustrating the ventilation shafts and winders.

FIGS. 11 to 13 show special developments of the invention, in which, in each case, two spinning apparatuses 1 are combined with one another to form an assembly comprising a double row of spinning units 9.

In FIG. 11, two rectangular containers 2 corresponding substantially to the construction according to FIG. 1 with two rows of spinning units 9 and two melt supply lines 7 are combined. The opposing walls between the two containers are omitted. In the bottom region between the rows of spinning units 9 there is, however, a possibility of a quenching channel 39 supplying both rows of spinning units. The melt supply lines 7 may also be replaced by a common line, to which the branch lines 8 are connected. With separate lines it is, however, possible to extrude separate melt flows, e.g., differently colored or treated melt flows. External heating of the heating chamber 38 defined by the two containers is provided, the heating system supply 34 and the condensate removal 35 corresponding to the construction according to FIG. 1.

A similarly constructed combination of two containers, but of circular cross section is shown in FIG. 12. Here, both containers are connected to a heating steam connection 46 and to a connection 47 for the condensate. Supply may be effected in any desired manner, e.g., by connecting a heating steam supply to the heating steam connection 46 and connecting a condensate outlet to the condensate line 47.

Finally, FIG. 13 shows in cross section a two-row spinning installation, the spinning units 9 of which are, for example, at a distance 32 (FIG. 9) apart which corresponds to the length of a bobbin tube 44. The spinning units 9 and the container 2 correspond to the representation of FIG. 11. Here too, heating of the container is effected by external heating. Provided below the common container are two blowing or ventilating boxes 41, which are each supplied with quench air from a quenching chamber 40A, 40B, and two spinning chambers 42, while the groups of filaments 43 are wound into yarn packages 45 on bobbin tubes 44. If, for example, ten spinning units are disposed in each row, it is then possible to use winding spindles 52 onto which ten bobbin tubes 44 may be mounted in succession so that the resulting yarn may be jointly wound. The contact rollers for driving the packages 45 at the package periphery are diagrammatically illustrated and denoted by 53.

What is diagrammatically illustrated in FIG. 13 is a spinning installation for a godet free comb spinning mill. If, however, draw-off devices such as godets for manufacturing finished stretched yarns (FOY) are to be provided, then in such case all of the godet axes are preferably provided parallel to the axes of the winding spindles 52 and to the spinning units 9 of the spinning beam 1, which are disposed in a longitudinal direction parallel and behind one another.

In the drawings and specification, there has been set forth a preferred embodiment of the invention, and although specific terms are employed, they are used in a generic and descriptive sense only and not for purposes of limitation.

That which is claimed:

1. A melt spinning apparatus for extruding and spinning thermoplastic filaments, comprising a gas tight container defining a top wall and a bottom wall, with the top and bottom walls having vertically aligned top and bottom openings therein respectively, a melt spinning unit disposed in the container and extending between the top and bottom openings, said melt spinning unit comprising a) a first pipe secured in said top opening and extending downwardly therefrom, b) a second pipe secured in said bottom opening and extending upwardly therefrom, c) a supporting plate secured to each of said first and second pipes so as to interconnect the same, with the supporting plate filling the internal cross section of each of said first and second pipes, d) a melt metering pump secured to said supporting plate, e) a spinneret assembly secured below said supporting plate, and f) a melt distribution line extending into said supporting plate and leading to said melt metering pump and from said melt metering pump to said spinneret assembly.

2. The melt spinning apparatus as defined in claim 1, wherein said melt metering pump is positioned below the supporting plate.

3. The melt spinning apparatus as defined in claim 2, wherein the melt metering pump and the spinneret assembly are releasably interconnected to each other.

4. The melt spinning apparatus as defined in claim 1, wherein the spinneret assembly is releasably interconnected to the inner periphery of the second pipe.

5. The melt spinning apparatus as defined in claim 1, wherein the spinneret assembly comprises a tubular casing, a spin plate having a plurality of apertures therethrough supported within the casing, a filter insert supported in the casing above the spin plate, a sealing diaphragm supported in the casing above the filter insert, and a pressure piston supported in the casing above the sealing diaphragm and which is axially moveable against the sealing diaphragm.

6. The melt spinning apparatus as defined in claim 5, wherein the pressure piston includes a central bore through which the melt passes, and wherein the central bore includes a static mixing element.

7. The melt spinning apparatus as defined in claim 1, wherein said melt metering pump is positioned above the supporting plate.

8. The melt spinning apparatus as defined in claim 7, wherein the supporting plate and the spinneret assembly are releasably interconnected to each other.

9. The melt spinning apparatus as defined in claim 1, wherein said melt metering pump includes a drive shaft which extends within said first pipe and upwardly through said top opening.

10. The melt spinning apparatus as defined in claim 1, further comprising a melt supply line which extends in a direction perpendicular to and adjacent the first and second pipes, and a branch line extending from the melt supply line to the melt distribution line.

11. The melt spinning apparatus as defined in claim 10, wherein said apparatus comprises a plurality of said melt spinning units disposed in a row within said container, and wherein one of said branch lines extends from said melt supply line to the melt distribution line of each of said melt spinning units.

12. The melt spinning apparatus as defined in claim 11, wherein the melt supply line is positioned at an elevation above a point at which each branch line connects with the associated melt distribution line, so as to provide a gradient between the melt supply line and the supporting plate of each melt spinning unit.

13. The melt spinning apparatus as defined in claim 1, wherein the container is tubular and of generally circular cross section.

14. The melt spinning apparatus as defined in claim 1, wherein the container is of generally rectangular cross section.

15. The melt spinning apparatus as defined in claim 10, wherein the container has an end face, and wherein the melt supply line extends in a sealed manner through said end face.

16. The melt spinning apparatus as defined in claim 1, wherein the first and second pipes are coaxially disposed, and wherein the first and second pipes are sealably secured in the top and bottom openings, respectively.

17. The melt spinning apparatus as defined in claim 16, wherein the first and second pipes are each sealably secured to said supporting plate.

18. The melt spinning apparatus as defined in claim 1, wherein the second pipe is welded to the bottom wall so as to be sealably secured in the bottom opening, and wherein the first pipe is sealably secured in the top opening by a construction which includes a mounting ring which coaxially surrounds the first pipe and is sealably secured within the top opening of the top wall.

19. The melt spinning apparatus as defined in claim 1, wherein the second pipe is sealably secured in the bottom opening by a construction which includes a mounting ring secured in the bottom opening, with the mounting ring having an inwardly directed radial collar, a threaded ring having an external thread sealably mounted onto the second pipe, with the threaded ring having an outwardly directed radial collar which is positioned to engage the radial collar of the mounting ring, a ring nut threadedly connected to the threaded ring for pressing the radial collars of the mounting ring and threaded ring together, and a sealing ring disposed between said radial collars.

20. The melt spinning apparatus as defined in claim 1, further comprising a supply line for delivering a gaseous heating medium into said containers and an outlet for removing condensate of the heating medium from the container.

21. The melt spinning apparatus as defined in claim 20, wherein the container includes a condensate collection chamber, and a heating device positioned within the collection chamber.

22. A melt spinning apparatus for extruding and spinning thermoplastic filaments to form a plurality of multi-filament yarns, comprising, a gas tight container defining a top wall and a bottom wall, with the top and bottom walls having a plurality of pairs of vertically aligned top and bottom openings therein respectively, and with the pair of openings arranged in a row, a plurality of melt spinning units disposed along said row of openings in the container, with each of the units extending between a pair of aligned top and bottom openings and comprising a) a first pipe secured in said top opening and extending downwardly therefrom, b) a second pipe secured in said bottom opening and extending upwardly therefrom, c) a supporting plate secured to each of said first and second pipes so as to interconnect the same, with the supporting plate filling the internal cross section of each of said first and second pipes, d) a melt metering pump secured to said supporting plate, e) a spinneret assembly secured below said supporting plate, and f) a melt distribution line extending into said supporting plate and leading to said melt metering pump and from said melt metering pump to said spinneret assembly, a ventilation shaft disposed below the container and so as to communicate with each of said spinneret assemblies of said melt spinning units and receive the filaments extruded therefrom, and a winder for winding the extruded filaments into yarn packages which are disposed coaxially upon a winding spindle, with the axis of the winding spindle being disposed parallel to the row of openings.

23. The melt spinning apparatus as defined in claim 22, wherein said container comprises a second row of said pairs of openings in said top and bottom walls and which is parallel to said first mentioned row, and a second plurality of said melt spinning units disposed along said second row.

24. A method of fabricating a melt spinning apparatus comprising the steps of providing a container having a top wall, a bottom wall, and at least one open end, and with the top and bottom walls having vertically aligned top and bottom openings therein respectively, assembling a structural unit comprising first and second pipes which are interconnected in a generally coaxial arrangement by a supporting plate, with said supporting plate including a melt distribution line extending thereinto, a melt supply line, and a branch line connected between the melt supply line and the melt distribution line of the supporting plate, inserting the assembled structural unit through the open end of the container to a position wherein the first and second pipes are respectively aligned with the top and bottom openings, closing the open end of the container, connecting the melt supply line so as to extend outwardly from the container, and securing the first and second pipes to the respective top and bottom openings, and such that the first and second pipes remain freely accessible from the outside of the container for mounting other components therein.

* * * * *

UNITED STATES PATENT AND TRADEMARK OFFICE
CERTIFICATE OF CORRECTION

PATENT NO. : 6,083,432

DATED : July 4, 2000

INVENTOR(S) : Schafer

It is certified that error appears in the above-identified patent and that said Letters Patent is hereby corrected as shown below:

Title page, [56] References Cited, U.S. PATENT DOCUMENTS, insert the following:

--5,051,088 9/1991 Frank--.

Title page, [56] References Cited, FOREIGN PATENT DOCUMENTS, insert the following:

--720,032 12/1954 United Kingdom--.

Column 10, line 29, "containers" should read --container,--.

Signed and Sealed this

Tenth Day of April, 2001

*Attest:*

Nicholas P. Godici

NICHOLAS P. GODICI

*Attesting Officer*

*Acting Director of the United States Patent and Trademark Office*